US008502096B2

(12) United States Patent
Lee

(10) Patent No.: US 8,502,096 B2
(45) Date of Patent: Aug. 6, 2013

(54) POWER ADAPTER

(75) Inventor: Chia-Yun Lee, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 216 days.

(21) Appl. No.: 13/101,134

(22) Filed: May 4, 2011

(65) Prior Publication Data

US 2012/0257333 A1 Oct. 11, 2012

(30) Foreign Application Priority Data

Apr. 7, 2011 (TW) ..... 100112108

(51) Int. Cl.
*H01H 17/08* (2006.01)
*H01H 15/00* (2006.01)

(52) U.S. Cl.
USPC ..... 200/243

(58) Field of Classification Search
USPC ..... 200/543, 413, 418, 420, 423, 410, 200/411, 415, 424, 430, 179, 11 R, 19.18, 200/468–471, 564
See application file for complete search history.

(56) References Cited

U.S. PATENT DOCUMENTS

| | | | | |
|---|---|---|---|---|
| 5,613,600 | A * | 3/1997 | Yokoji et al. | 200/564 |
| 6,396,016 | B1 * | 5/2002 | Lin et al. | 200/564 |
| 6,875,059 | B2 * | 4/2005 | Sivertsen | 439/638 |
| 6,921,874 | B2 * | 7/2005 | Tseng | 200/544 |
| 7,134,887 | B1 * | 11/2006 | Keely | 439/131 |

* cited by examiner

*Primary Examiner* — Edwin A. Leon
*Assistant Examiner* — Anthony R. Jimenez
(74) *Attorney, Agent, or Firm* — Altis Law Group, Inc.

(57) ABSTRACT

A power adapter includes a shell, a power converter, a first power line, a second power line, a switch received in the shell, and a DC plug. The first power line connects the power rectifier to an external power source, and includes a first terminal and a second terminal. The second power line connects the power rectifier to the DC plug. The switch includes a fixed shaft fixed on the shell, a rotating plate rotatably positioned on the fixed shaft, a number of poles equidistantly disposed on the rotating plate, a number of conductive sheets for conducting the first and second terminal, and a stirring device connecting to the second power line. The conductive sheets are disposed on the rotating plate corresponding to the odd/even poles. When the second power line is pulled, the stirring device rotates the rotating plate to electrically connect or disconnect the first and second terminal.

11 Claims, 3 Drawing Sheets

POWER ADAPTER

BACKGROUND

1. Technical Field

The present disclosure relates to power adapters and, particularly, to a power adapter for conveniently providing electrical connection or disconnection to an external power source.

2. Description of Related Art

Power adapters are used for rectifying alternate current (AC) of an external power source to direct current (DC) which electronic devices (e.g. notebooks) need. When the power adapter is electrically connected to the external power source, the power adapter starts to work, and consumes electrical energy. Therefore, a user must remove the power adapter from the external power source to save electrical energy, which is very inconvenient.

Therefore, it is desirable to provide a power adapter that can overcome the above-mentioned limitations.

BRIEF DESCRIPTION OF THE DRAWINGS

Many aspects of the embodiments should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
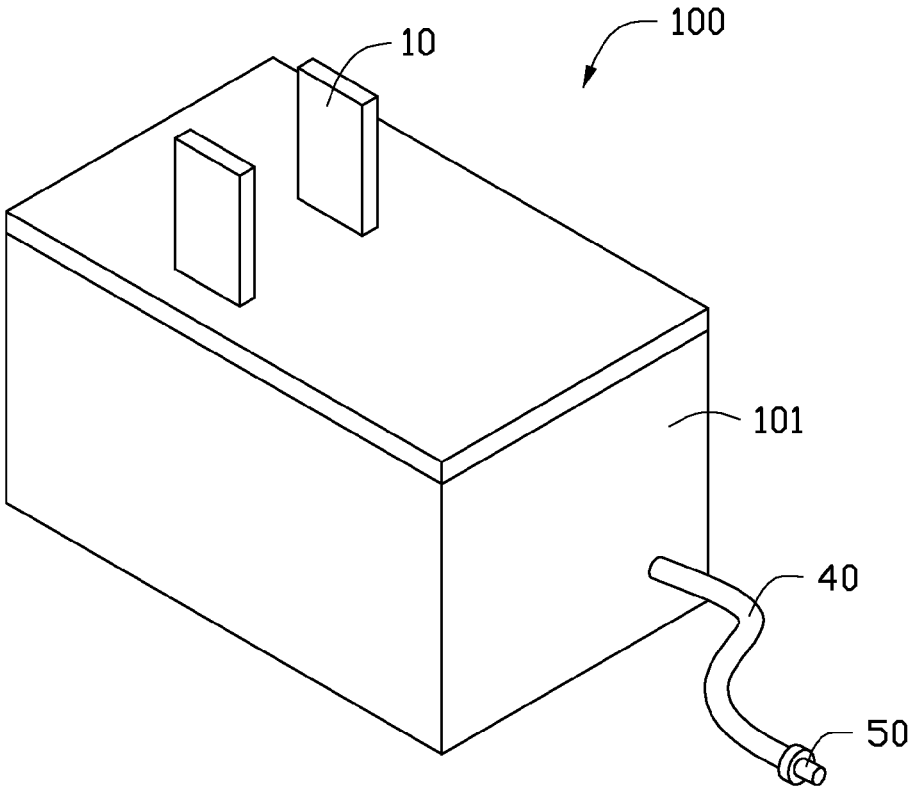
FIG. 1 is a schematic view of a power adapter, according to an exemplary embodiment.
Figure 2:
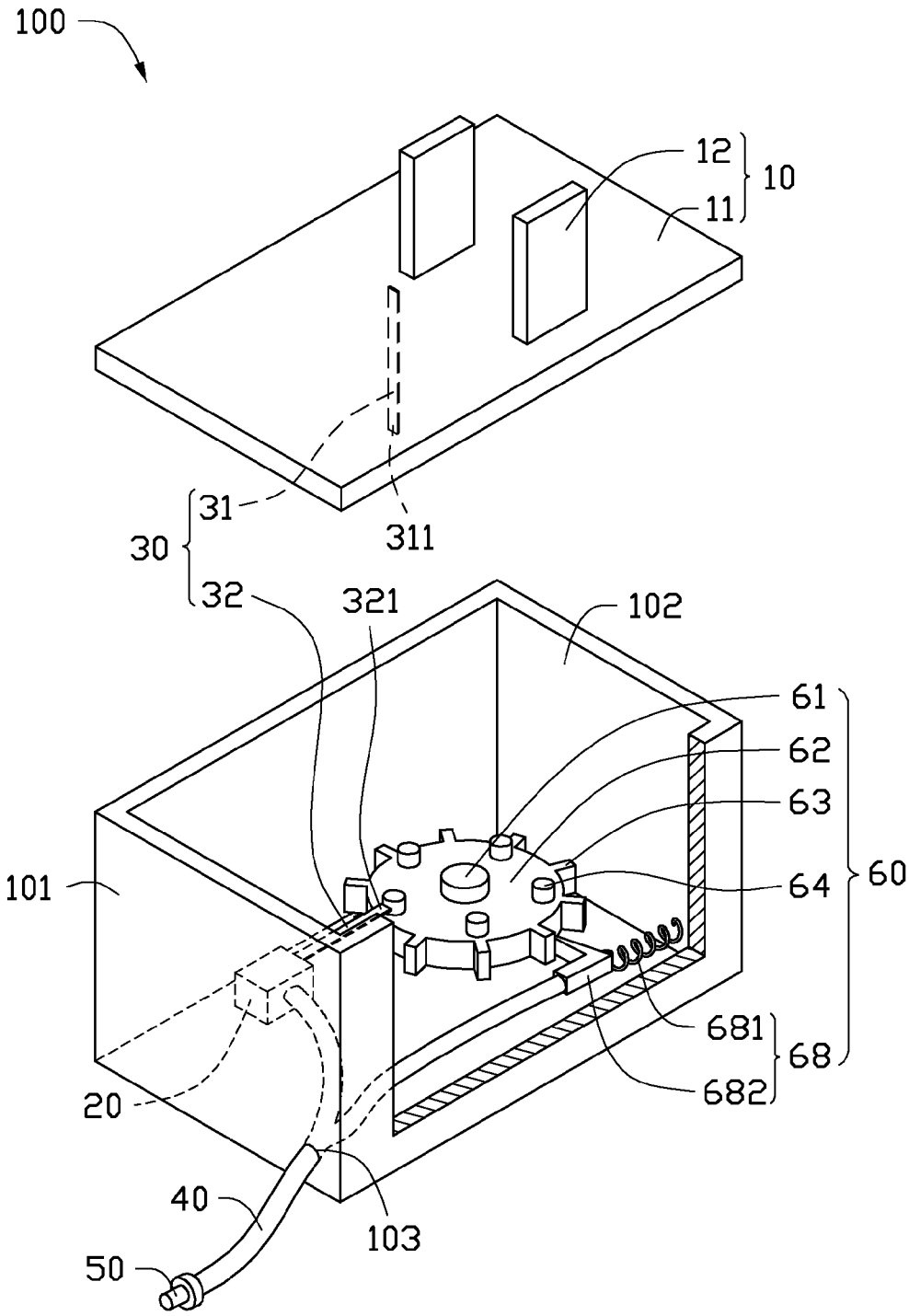
FIG. 2 is a partially cut-away view of the power adapter of FIG. 1.

Referring to FIG. 1 and FIG. 2, a power adapter 100 for electrically connecting an external power source (not shown) to an electronic device (not shown), according to an embodiment, includes a shell 101, an alternate current (AC) plug 10, a power rectifier 20, a first power line 30, a second power line 40, a direct current (DC) plug 50, and a switch 60.

The shell 101 is substantially cubic and defines a rectangular opening 102 for receiving the power rectifier 20 and the switch 60 therein. The shell 101 also defines a through hole 103 in a sidewall of the shell 101.

The AC plug 10 includes a base 11 and two pins 12 protruding outward from the base 11. The base 11 is used for sealing the opening 102. The two pins 12 are used for inserting into the external power source.

The power rectifier 20 is used for rectifying alternating current of the external power source to direct current, which the electronic device needs.

The first power line 30 is used for electrically connecting the power rectifier 20 to the two pins 12, and includes a first portion 31 and a second portion 32 disconnected from the first portion 31. In this embodiment, both of the first portion 31 and the second portion 32 are conductive sheets. One end of the first portion 31 is fixed on the base 11 and is electrically connected to one of the two pins 12, the other end of the first portion 31 is served as a first terminal 311 used for alternately electrically connecting to the switch 60. One end of the second portion 32 is electrically connected to the power rectifier 20, the other end of the second portion 32 serves as a second terminal 321 used for alternately electrically connecting to the switch 60, and thus to electrically connect or disconnect to the first terminal 311.

The second power line 40 is electrically connecting the power rectifier 20 to the DC plug 50, and extends outward from the shell 101 through the through hole 103.

The DC plug 50 is used for inserting into the electronic device.

Figure 3:
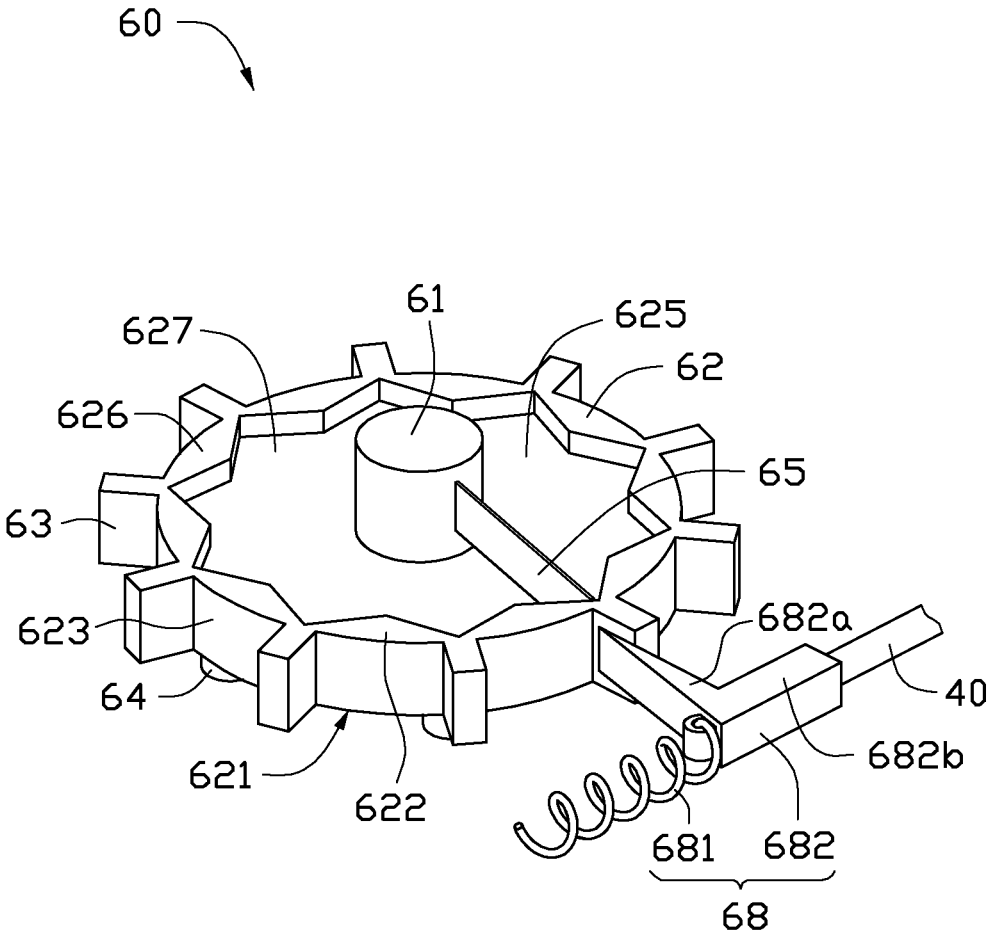
FIG. 3 is a schematic view of a switch of the power adapter of FIG. 1.

Referring to FIG. 3, the switch 60 is used for controlling the power rectifier 20 to electrically connect or disconnect to the AC plug 10, and includes a fixed shaft 61, a rotating plate 62, ten poles 63, five conductive sheets 64, a first elastic 65, and a stirring device 68. The number of the poles 63 is twice of that of the conductive sheets 64. The numbers of the poles 63 and the conductive sheets 64 are not limited to this embodiment.

One end of the fixed shaft 61 is fixed on a sidewall of the shell 101. The center of the rotating plate 62 is rotatably disposed on the other end of the fixed shaft 61. The rotating plate 62 includes a first surface 621, a second surface 622 opposite to the first surface 621, and an outer circumferential surface 623. The outer circumferential surface 623 connects the first surface 621 and the second surface 622. The poles 63 perpendicularly equidistantly protrude from the outer circumferential surface 623. The conductive sheets 64 are disposed on the first surface 621 corresponding to five of the ten poles 63. There is, a conductive sheet 64 corresponding to one of two adjacent poles 63, there is no conductive sheet 64 corresponding to the other one of the two adjacent poles 63, that is, the conductive sheets 64 are corresponding to the odd/even poles 63. Each conductive sheet 64 is used for electrically connecting the first terminal 311 and the second terminal 321.

The second surface 622 defines a round groove 625 of which the fixed shaft 61 is located at the center. The groove 625 includes an inner sidewall 626 defining a number of continuous arranged notches 627 corresponding to the poles 63. One end of the first elastic element 65 is fixed on the fixed shaft 61. The other end of the first elastic element 65 is received in one notch 627.

The stirring device 68 includes a second elastic element 681 and a hook 682 fixedly connected to the second elastic element 681. The second elastic element 681 is fixed on a sidewall of the shell 101. The hook 682 includes a main body **682*a* and a connecting portion 682*b* substantially perpendicular to the main body 682*a*. The connecting portion 682*b* is fixed with the second elastic element 681 along the stretching direction thereof. The main body 682*a* is fixed on the end of the connecting portion 682*b* which intersects with the second elastic element 681, and is used for pressing on the poles 63 to drive the rotating plate 62 to rotate. The second power line 40 is fixedly connected to the end of the connecting portion 682*b* away from the second elastic element 681**.

In use, if currently, both of the first terminal 311 and the second terminal 321 resist on a conductive sheet 64, the power rectifier 20 is electrically connected to the AC plug 10. Then the second power line 40 is pulled, the second elastic element 681 stretches, the hook 682 resists one pole 63 to drive the rotating plate 62 to rotate, and thus the first elastic element 65 is removed from one notch 627 to the next adjacent notch 627. There is no conductive sheet 64 corresponding to the next pole 63, therefore, the first terminal 311 is electrically disconnected to the second terminal 321, the power rectifier 20 is electrically disconnected to the AC plug 10. Following the above steps, if the second power line 40 is pulled again, the rotating plate 62 is driven by the hook 682 to rotate, and the power rectifier 20 is electrically connected to the AC plug 10.

In this embodiment, the first elastic element 65 is an elastic sheet, and the second elastic element 681 is a spring. In other embodiments, the first elastic element 65 also can be an elastic pole, and the second elastic element 681 also can be an elastic rubber band.

In this embodiment, the hook 682 is made of insulating materials. In other embodiments, the hook 682 can also be made of conductive material, and the hook 682 is not electrically connected to the second power line 40.

In other embodiments, the power rectifier 20 can also be positioned outside the shell 101.

In this embodiment, the poles 63 are integrated with the rotating plate 62. In other embodiments, the poles 63 can also be fixed on the rotating plate 62 by other manner.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A power adapter, comprising:

a shell;

an alternate current (AC) plug for connecting to an AC power source;

a power rectifier configured for converting the AC power source to a direct current (DC) power source which an electronic device needs;

a DC plug for connecting to the electronic device;

a first power line configured for connecting the power rectifier to the AC power source and comprising a first portion and a second portion, one end of the first portion being electrically connected to the AC plug, the other end of the first portion comprising a first terminal, one end of the second portion being electrically connected to the power rectifier, the other end of the second portion comprising a second terminal, the first terminal being positioned adjacent to the second terminal;

a second power line electrically connecting the power rectifier to the DC plug;

a switch received in the shell, and comprising:

a fixed shaft fixed in the shell;

a rotating plate rotatably positioned on the fixed shaft;

a plurality of first poles and a plurality of second poles, all the first poles and the second poles equidistantly positioned on the rotating plate and arranged in a first circle, at least one of the second poles being positioned between two neighboring first poles;

a plurality of conductive sheets positioned on the rotating plate and arranged in a second circle, each conductive sheet being positioned adjacent to a corresponding one of the fist poles; and a stirring device configured for driving the first poles and the second poles to rotate the rotating plate such that the conductive sheets alternate between connecting and disconnecting the first terminal to the second terminal, wherein the second power line is further fixedly connected to the stirring device and configured for pulling the stirring device to drive the first poles and the second poles.

2. The power adapter of claim 1, wherein the fixed shaft is positioned on the center of the rotating plate.

3. The power adapter of claim 2, wherein the rotating plate comprises a first surface, a second surface and an outer circumferential surface connected to the first and second surfaces, the second surface is opposite to the first surface, the conductive sheets are positioned on the first surface, the first poles and the second poles are positioned on the outer circumferential surface, the second surface defines a round groove of which the fixed shaft is located at the center, an inner sidewall of the groove defines a plurality of continuous arranged notches corresponding to the first poles and the second poles, the switch further comprises a first elastic element, one end of the first elastic element is fixed on the fixed shaft, the other end of the first elastic element is received in one notch, when the rotating plate rotates, the first elastic element is capable of removing from one notch to the adjacent notch.

4. The power adapter of claim 3, wherein the first elastic element is an elastic sheet or an elastic pole.

5. The power adapter of claim 1, wherein the stirring device comprises a second elastic element fixed on the shell and a hook, the hook is fixedly connected to the second elastic element and configured for driving the first poles and the second poles to rotate the rotating plate.

6. The power adapter of claim 5, wherein the second elastic element is an elastic spring or an elastic runner band.

7. The power adapter of claim 5, wherein the hook is made of isolating material.

8. The power adapter of claim 5, wherein the hook comprises a main body and a connecting portion perpendicular to the main body, the main body is configured for driving the first poles and the second poles, the connecting portion is fixed with the second elastic element along the stretching direction of the second elastic element.

9. The power adapter of claim 1, wherein the shell defines a through hole, the second power line extends outwards from the shell through the through hole.

10. The power adapter of claim 1, wherein the AC plug comprises a base and at least two pins protruding from the base, the shell defines an opening, the base seals the opening, and one of the pins is electrically connected to the first terminal.

11. The power adapter of claim 1, wherein each of the second poles is positioned between two neighboring first poles.

* * * * *